US006337615B1

(12) United States Patent
Dittmann et al.

(10) Patent No.: US 6,337,615 B1
(45) Date of Patent: Jan. 8, 2002

(54) ELECTRICAL COIL, ESPECIALLY FOR A RELAY, AND METHOD FOR PRODUCING THE SAME

(75) Inventors: Michael Dittmann; Angelo Polese, both of Berlin (DE)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/581,653

(22) PCT Filed: Nov. 16, 1998

(86) PCT No.: PCT/DE98/03370

§ 371 Date: Aug. 16, 2000

§ 102(e) Date: Aug. 16, 2000

(87) PCT Pub. No.: WO99/33073

PCT Pub. Date: Jul. 1, 1999

(30) Foreign Application Priority Data

Dec. 18, 1997 (DE) ..... 197 56 604

(51) Int. Cl.[7] ..... H01H 51/22; H01H 9/00; H01F 1/00; H01F 7/00

(52) U.S. Cl. ..... 335/299; 336/82; 336/206; 336/209

(58) Field of Search ..... 335/282, 299, 335/210–214; 336/82, 96, 205, 206, 209

(56) References Cited

U.S. PATENT DOCUMENTS 5,412,362 A * 5/1995 Ikeuchi ..... 335/213
5,426,407 A * 6/1995 Van Den Berg et al. .... 335/210

* cited by examiner

*Primary Examiner*—Ramon M. Barrera
(74) *Attorney, Agent, or Firm*—Baker & Daniels

(57) ABSTRACT

The inventive coil comprises a coil body (1) on which an exciter winding (7) is arranged. A peripheral insulation winding (8) consisting of an insulating fiber is formed over the exciter winding, the individual windings of the insulating winding being bonded to each other in order to form a continuous insulation layer. The insulation winding can be made up of a mineral fiber impregnated with duromer resin or a thermoplastic fiber which has been melted on by subsequent heat treatment.

8 Claims, 1 Drawing Sheet

ELECTRICAL COIL, ESPECIALLY FOR A RELAY, AND METHOD FOR PRODUCING THE SAME

This application is an application under 35 USC Section 371.

BACKGROUND OF THE INVENTION

The invention relates to an electrical coil comprising a coil body, an exciting winding arranged on the coil body between flanges, and a jacket of insulating material arranged over the exciting winding. Furthermore, the invention relates to a method for producing such a coil.

In electrical coils, in particular for use in relays or similar switching apparatus, it is often desirable to protect the sensitive winding wires against damage from outside by means of a jacket. In addition thereto, such an enclosure of the coil also has the function of protecting the surroundings of the coil, and thus in particular the relay contacts, against outgassing from the varnish insulation of the winding wire.

DE 36 42 246, for example describes a method of enclosing a coil with insulating material, with the jacket being made by injection molding in a mold. This entails quite considerable expenditure since it does not only necessitate a mold and an injection molding machine, but this injection molding operation also needs to be provided for as a completely separate step in the manufacturing process.

SUMMARY OF THE INVENTION

It is the object of the invention to design a coil with a jacket, and to indicate a method of making the same, such that said jacket increases the coil diameter as little as possible only and can be made with low manufacturing expenditure.

According to the invention, this object is met with a coil of the type indicated at the outset in that the jacket is formed as a peripheral insulating winding having at least one winding layer of insulating fiber material, with the juxtaposed turns thereof being adhered to each other so as to form a continuous insulating layer.

The invention thus provides a jacket in the form of an additional winding using insulating fiber material which, upon winding of the exciting coil, is applied in the same manner and with the same winding machine in one layer or, if necessary, also in several layers on top of the exciting winding and is adhesively bonded together and also to the flanges, respectively. There is thus no additional expenditure whatsoever required for an injection molding machine and a casting mold, respectively.

The method according to the invention for producing such a coil consists in that, after winding of the exciting coil, an at least one-layer insulating winding of insulating fiber material is applied over the exciting winding and that the individual turns of the insulating winding are adhered to each other. Preferably, the insulating fiber proper may consist of thermoplastic material, with the possibility of melting on the fiber by a subsequent heat treatment so as to thereby adhere the individual turns to each other, or it is possible to use a mineral fiber which is impregnated with a casting resin, for example, a duromer resin and cured after winding. Depending on the type of the resin used, either automatic curing at room temperature or curing by heat treatment is feasible. In principle, it would also be conceivable to impregnate the fiber with resin only after the winding operation, with the resin then spreading through the fiber.

However, this necessitates an additional step comprising metering of the resin as well as specific precautions to make sure that the resin really is distributed over the entire surface. In any case, by adhering the insulating winding according to the invention, a gastight enclosure over the copper/varnish wire winding is provided.

BRIEF DESCRIPTION OF THE DRAWINGS

The invention shall now be elucidated in more detail by way of an embodiment shown in the drawings, wherein.

DETAILED DESCRIPTION OF THE PREFERRED EMBODIMENT

Figure 1:
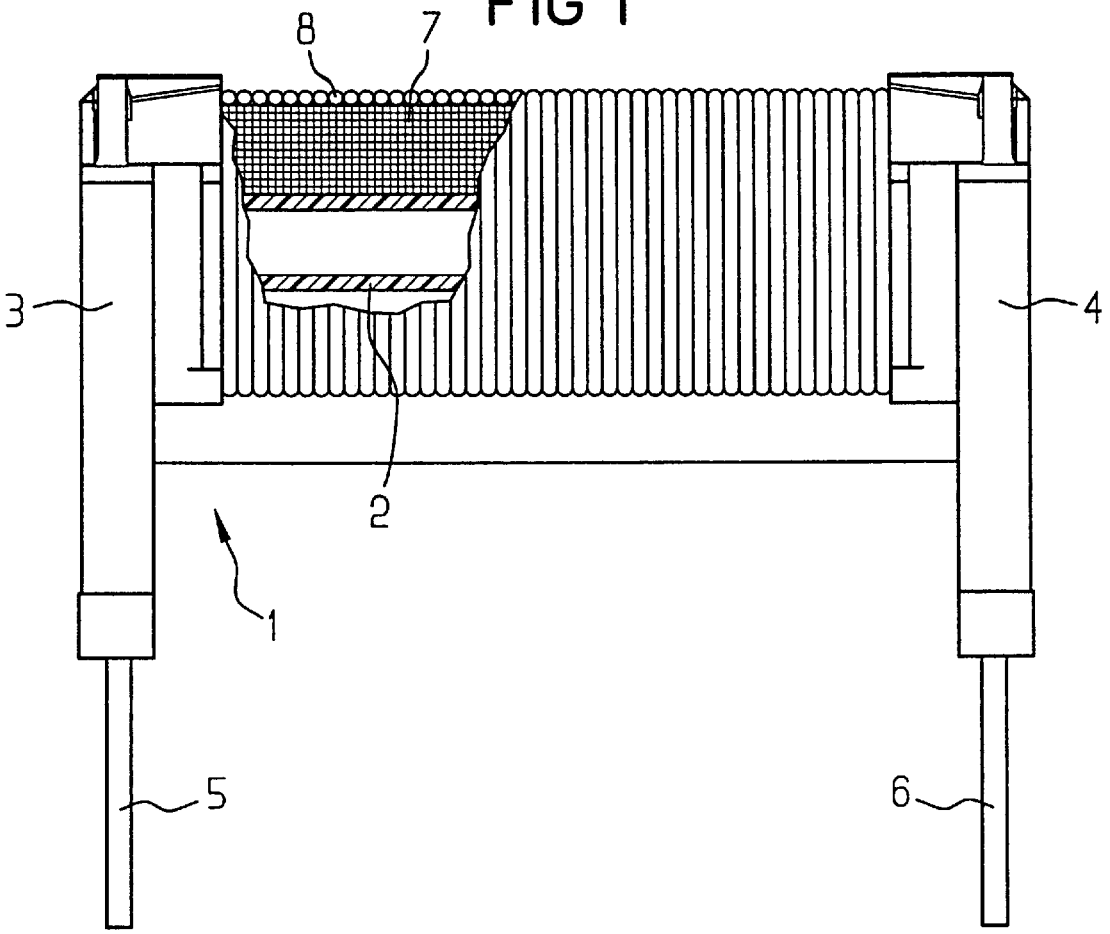
FIG. 1 shows a side view of a relay coil designed according to the invention, with the coil winding being partly cut open.
Figure 2:
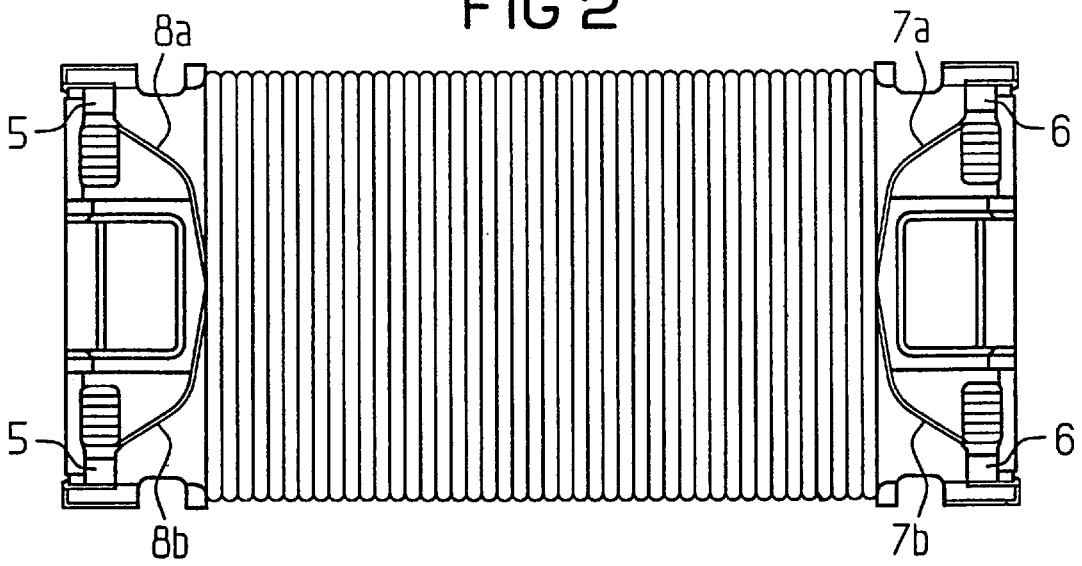
FIG. 2 shows a plan view of the coil of FIG. 1.

The coil illustrated in the drawing comprises a coil body 1 of plastics material that defines a coil tube 2 and a flange 3 and 4, respectively, at each end thereof. Flanges 3 and 4 each have coil terminal pins 5 and 6 embedded therein in pairs.

An exciting winding 7 is wound in conventional manner on the coil tube between the two flanges 3 and 4. Arranged on top of this winding 7 is furthermore a one-layer or also multi-layer insulting winding 8. This insulating winding may consist of a mineral fiber which is impregnated with duromer resin prior to the winding operation, but which is otherwise wound in the same manner as exciting winding 7. After the winding operation, the duromer resin is cured by annealing. Instead of the impregnated mineral fiber, however, it is also possible to employ a fiber of thermoplastic material, with the fiber material after winding being melted on by heat treatment, so that in this case too, as in the preceding case, the individual turns of the insulating winding are adhered to each other. This insulating winding at the ends thereof, of course, is adhered to the coil flanges 3 and 4 as well, so that a closed sheath is produced over the exciting winding. The winding ends 8*a* and 8*b* of the insulating winding may be secured, for example, to the unused terminal pins 5 of the coil body, while the wire terminal ends 7*a* and 7*b* of winding 7 are attached to and contacted at terminal pins 6. In case there are no unused terminal pins available, the ends of the insulating winding may also be wound over ends 7*a* and 7*b* of the exciting coil to the same terminal pins 6 after the wire terminals have been contacted prior thereto by soldering or welding.

In addition thereto, it would also be conceivable to form on the coil body winding pegs, not shown, of insulating material for the insulating winding.

What we claim is:

1. An electrical coil comprising a coil body, an exciting winding arranged on the coil body between flanges, and a jacket of insulating material arranged over the exciting winding, wherein the jacket is formed as an insulating winding having at least one winding layer of a thermoplastic fiber such that the juxtaposed turns thereof are adhered to each other by melting on so as to form a continuous insulating layer.

2. The coil of claim 1, wherein the winding ends of the insulating winding are attached to unused terminal, pins of the coil body.

3. The coil of claim 1, wherein the winding ends of the insulating winding are attached to terminal pins of the coil body over the electrically contacted ends of the exciting winding.

4. The coil of claim 1, wherein the winding ends of the insulating winding are attached to an integrally formed peg of the coil body.

5. A method for producing an electrical coil comprising a coil body, an exciting winding arranged on the coil body between flanges, and a jacket of insulating material arranged over the exciting winding, wherein a coil body has an exciting winding applied thereon and the latter then is provided with an insulating jacket, wherein, after winding of the exciting coil, an at least one-layer insulating winding of a thermoplastic fiber is applied over the exciting winding, and wherein the individual turns of the insulating windings are melted on and adhered to each other by a subsequent heat treatment.

6. The method of claim 5, wherein the winding ends of the insulating winding are attached to unused terminal pins of the coil body.

7. The method of claim 5, wherein the winding ends of the insulating winding are attached to terminal pins of the coil body over the electrically contacted ends of the exciting winding.

8. The method of claim 5, wherein the winding ends of the insulating winding are attached to an integrally formed peg of the coil body.

* * * * *